United States Patent [19]

Kanno et al.

[11] Patent Number: 4,458,899

[45] Date of Patent: Jul. 10, 1984

[54] GAME CAPABLE OF COLLECTING AND THEN RANDOMLY DISPENSING OBJECTS

[75] Inventors: Hideyuki Kanno; Takahiko Ichimura, both of Tokyo, Japan

[73] Assignee: Tomy Kogyo Co., Ltd., Japan

[21] Appl. No.: 404,126

[22] Filed: Aug. 2, 1982

[30] Foreign Application Priority Data

Aug. 26, 1981 [JP] Japan ..... 56-126363

[51] Int. Cl.[3] ..... A63F 5/04

[52] U.S. Cl. ..... 273/138 R; 446/9

[58] Field of Search ..... 273/143, 138 R, 138 A; 46/2-5; 194/DIG. 11

[56] References Cited

U.S. PATENT DOCUMENTS

| | | | |
|---|---|---|---|
| 2,152,599 | 3/1939 | Mills | 273/143 R |
| 2,650,686 | 9/1953 | Bigue | 273/143 R UX |
| 4,002,335 | 1/1977 | Bailey | 273/143 R X |
| 4,051,939 | 10/1977 | Murphy et al. | 273/143 R X |

FOREIGN PATENT DOCUMENTS

| | | | |
|---|---|---|---|
| 1111379 | 4/1968 | United Kingdom | 194/DIG. 11 UX |
| 1368622 | 10/1974 | United Kingdom | 273/143 R |
| 2067807 | 7/1981 | United Kingdom | 273/143 R |

*Primary Examiner*—Paul E. Shapiro

*Attorney, Agent, or Firm*—K. H. Boswell; Edward D. O'Brien

[57] ABSTRACT

A game capable of receiving and then seemingly randomly dispensing objects includes a housing which has an accumulator chamber located therein. The accumulator chamber can receive individual objects, accumulate them, and then dispense the objects so accumulated. An activation member is mounted on the housing in association with the accumulator chamber. Further, a chance member is mounted on the housing in association with the activation member. The chance member is capable of moving between a plurality of positions, at least one of the positions being a dispensing position. The activation member moves the chance member on the housing between its positions in response to reception of one of the objects in the accumulator chamber by the depositing of the object in the accumulator chamber. Objects are accumulated in the accumulator chamber as they are so deposited, with the chance member being moved with the deposition of each of the individual objects. If the chance member is moved to its dispensing position, then any of the objects so accumulated in the accumulator chamber are dispensed from the toy.

11 Claims, 10 Drawing Figures

24
22
54
31
20
78
56
52
58
68
70
60
38
86
132
92
90
126
39
98
34
88
94
96
103
26
28
102
42
48
44
40
50
32
46

GAME CAPABLE OF COLLECTING AND THEN RANDOMLY DISPENSING OBJECTS

BACKGROUND OF THE INVENTION

This invention is directed to a toy capable of accumulating a plurality of objects, and then, in a random manner, or seemingly random manner, dispensing these objects. The toy includes an accumulator means, a chance means, and an activation means. Upon introduction of an object to the accumulator means, the object interacts with the activation means, which in turn interacts with the chance means, which moves the chance means to produce the random, or seemingly random, output of the toy.

As is evident by their sustained use, dating back to earlier cultures, games which incorporate random, or seemingly random, devices are extremely popular. Dice games and the like have been known for hundreds of years. More recently, games utilizing spinners and other random devices have met with large public acceptance.

In most childrens games which utilize dice, spinners or the like as a part of the game, the child must manipulate other playing pieces in response to the random number, color, or other instructions indicated by the dice, spinner or the like. These types of games can thus be characterized as requiring additional input, etc., from the child or adult utilizing the game. While for older children or for adults, further manipulation of objects and the like is easily accomplished, for the young child, however, especially for a group of young children, without adult or older child supervision, the playing of such games is precluded because of the lack of the necessary sophistication and/or education required to further manipulate the games.

BRIEF DESCRIPTION OF THE INVENTION

In view of the above, it is a broad object of this invention to provide a toy which utilizes a random, or seemingly random, principle, which can be utilized by small children without the assistance of an adult or older, more sophisticated child. Further, it is an additional object of this invention to provide a self contained toy which is fascinating to use because of its random, or seemingly random, manner of action. Additionally, it is an object of this invention to provide a toy which, because of its construction and engineering principles is both economically produced, and is durable, thus providing for a long and continued useful life.

These and other objects, as will become evident from the remainder of this specification, are achieved in a toy capabe of receiving and dispensing objects which comprises: a plurality of said objects; a housing; an accumulator means located on said housing, said accumulator means capable of individually receiving said objects, accumulating said objects so received and dispensing all of said objects so accumulated; a movable mechanical chance means located on said housing in operative association with said accumulator means, said chance means movable between a plurality of positions, at least one of said positions being a dispensing position; activation means mounted on said housing in operative association with both said chance means and said accumulator means, said activation means moving said chance means from one of its positions to another of its positions upon reception of one of said objects by said accumulator means; said accumulator means dispensing any of said objects accumulated in response to said chance means moving to its dispensing position from another of its positions.

Preferredly, the activation means would be movable on the housing between at least an initial position and a subsequent position. The activation means would be movable from its initial position to the subsequent position by interaction of the activation means with one of the objects as the object is received by the accumulator means. In moving from the initial position to the subsequent position, the activation means would move the chance means from one of its positions to another of its positions.

Additionally, preferredly, an object guide means would be located on the housing in association with both the activation means and the accumulator means. The object guide means would be capable of receiving each of the objects and individually guiding the object to the accumulator means. The objects would interact with the activation means to move the activation means from its initial to its subsequent position as the object is guided by the guide means to the accumulator means.

Preferredly, a connecting means would be incorporated in the toy and would be movably mounted on the housing in a position associating it with the both the chance means and the accumulator means. The connecting means would be capable of moving between a retaining position and a discharge position. When in the retaining position, the interaction between the connecting means and the accumulator means would be such that the accumulator means would accumulate the objects so received by it and when the connecting means was in the discharge position, the accumulator means would dispense all of the objects it had so accumulated. The connecting means would move from its retaining position to its discharge position in response to the chance means moving from another of its positions to its dispensing position.

Preferredly the chance means would include a chance member movably mounted on the housing. The chance member would include a plurality of interacting means of a first type located on it, and at least one interacting means of a second type located on it. The interacting means of the first type would interact with the activation means to move the chance member in response to movement of the activation means from the activation means initial position to its subsequent position. The interacting means of the second type would interact with the connecting means to move the connecting means from its retaining position to its discharge position in response to movement of the chance member to a dispensing position.

The object guide means would comprise an object pathway located on the housing and having an inlet and an outlet with the inlet so located so as to receive the objects and the outlet located in association with the accumulator means so as to transfer objects from the object pathway to the accumulator means. The activation means would be located in association with the object pathway so as to be acted upon by an object as the object traverses through the pathway from the pathway inlet to the pathway outlet.

The chance member would preferably be rotatably mounted on the housing and would be capable of being moved stepwise by the activation means. The chance member would further include positioning means which would be capable of positioning the chance member in a plurality of stepwise positions as the chance means is rotated on the housing by the activation means. Further, the connecting means would include at least a first connecting member located on the housing in association with the chance member. The first connecting member would be movably mounted on the housing such that the interacting means of the second type which would be preferredly formed as a cam means located on the chance member could interact with the first connecting member when the chance means is in the dispensing position so as to move the first connecting member.

Preferredly, the accumulator means would comprise a chamber means located in the housing and having the outlet of the object pathway formed as a first opening in to it. The chamber means would further include a second opening having a closure means located in association with it. The second opening would be formed as an opening in the housing for discharge from the housing of any object accumulated in the chamber means. The objects would be capable of being accumulated in the chamber means by having the closure means sealing the second opening and the objects could be dispensed from the chamber means by having the closure means unseal the second opening. The closure means would be operatively associated with the connecting means which seal and unseal the second opening in response to movement of the first connecting member as it interacts with the cam means. A second connecting member could be formed as a part of the connecting means and located on the housing in association with first connecting member and the closure means. The second connecting member would be movable in response to movement of the first connecting member and the closure means would be movable in response to movement of the second connecting member. Preferredly, this would be accomplished by having the closure means include a closure member pivotally mounted on the housing between a sealed and an unsealed position and further having a closure biasing means associated with the closure member to bias the closure member from its sealed to its unsealed position. By locating at least a portion of the second connecting member on the housing in a position adjacent to the closure member, the second connecting member could move between a retaining position wherein the second connecting member retains the closure member in its sealed position against the bias of the closure means and a non-retaining position wherein the second closure member does not retain the closure means against the bias of the closure bias means, which allows the closure biasing means to move the closure member from its sealed to its unsealed position.

Further, the toy preferredly would include an activation member rotatably mounted on the housing in association with the object pathway and the chance member. An activating biasing means would be associated with the activation member and would bias the activation member from the subsequent position to the initial position. The activation member would be rotatably mounted on the housing by interaction of an object with the activation member to rotate the activation member against the bias of the activation biasing means. Said rotation of the activation member would result in interaction of the activation member with the chance member to rotate the chance member on the housing.

An indicating means could be further mounted on the housing in a position to interact with the activation member. Preferredly, the indicating means would be moved with respect to the housing as the activation member is moved from its subsequent position back to its initial position under the influence of the activation biasing means.

BRIEF DESCRIPTION OF THE DRAWINGS

This invention will be better understood when taken in conjunction with the drawings wherein.

Figure 1:
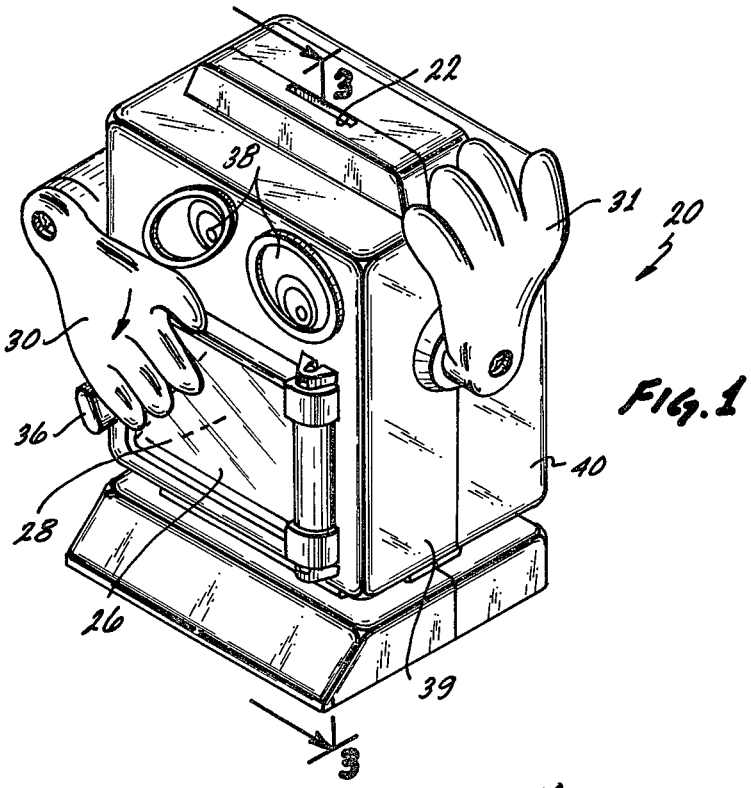
FIG. 1 is an oblique view of the outside appearance of the preferred embodiment of the invention in one spatial configuration.

The invention described in this specification and illustrated in the drawings utilizes certain concepts and/or principles as are set forth in the claims appended to this specification. Those skilled in the toy arts will realize that these principles and/or concepts are capable of being illustrated in a variety of illustrative embodiments. For this reason, this invention is not to be construed as being limited to the exact illustrated embodiment utilized herein, but is only to be construed as being limited by the claims.

DETAILED DESCRIPTION OF THE INVENTION

Figure 2:
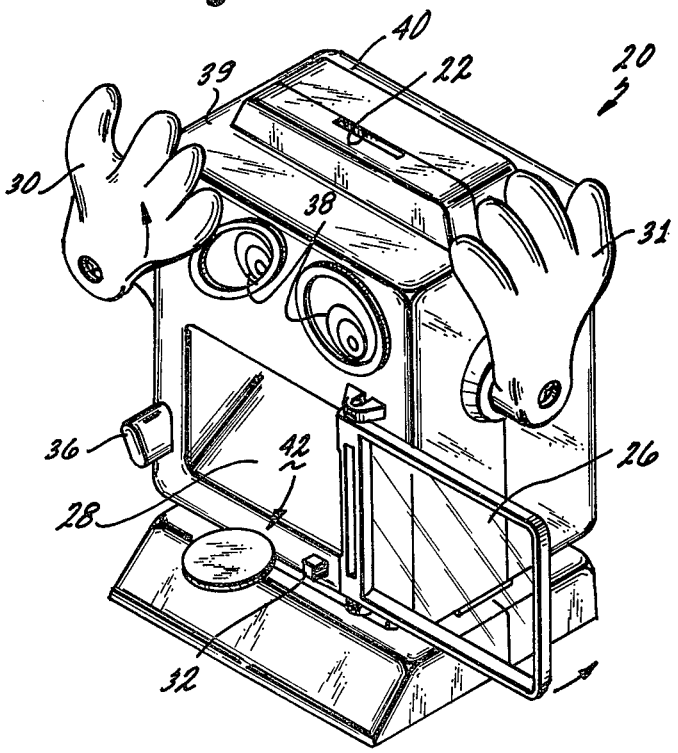
FIG. 2 is a view similar to FIG. 1 except that certain components of the preferred embodiment are shown in a different spatial configuration with respect to one another.

In FIGS. 1 and 2 a toy 20, an illustrative embodiment of this invention, is shown. Before describing the internal working components of the toy, a brief description of its use will facilitate further understanding of how these components work.

The toy 20 has several outwardly exposed component parts. These include an object slot 22, shaped to accept disk-like objects such as object 24 illustrated in FIG. 2. A hinged door 26 covers an accumulator chamber 28. The chamber 28 is sized such that it can accumulate a plurality of the objects 24 after they are inserted into the toy 20 by passing them through the slot 22.

The door 26 is maintained in a closed or sealed configuration as seen in FIG. 1 by the presence of the movable hand 30. In FIG. 1, the movable hand 30 is seen over the front of the door 26, which holds the door 26 in its closed or sealed configuration. In FIG. 2, the movable hand 30 has been raised such that it is no longer located in front of the door 26, allowing the door 26 to swing open to an open, or unsealed, configuration. A spring (identified later) biases a projection 32 forward, which in turn biases the door 26 from its closed to its open position. When the door 26 is closed, it pushes the projection 32 upwardly, tensing the bias of the unseen spring, and then the hand 30 is rotated downward, locking in this configuration and holding the door 26 in its closed position. The second hand 31 has no function and is for asthetic purposes only.

In utilizing the toy 20, a number of players are assembled and each has at the start of play a plurality of disks 24. Normally, the totality of the disks 24 would be segregated into groups by coloring the disks 24 different colors, such that each of the players of the game started the game with an equal number of disks, each of its own individual color. The players in turn push one of the disks 24 into the slot 22. The disks 24 go into the slot 22 and then are accumulated within the chamber 28. The objects 24 are inserted into the toy 20 until a random number of them have been pushed through the slot 22, such that a chance mechanism, as hereinafter described, is operated, causing the hand 30 to raise and the door 26 to open and all of the objects 24 located in the chamber 28 slide out of the chamber 28 and then pass into the possession of the player whose object 24 was last inserted into the toy 20.

A knob 34 located on the back of the toy 20 is then turned through some random degree of rotation to reset the chance mechanism, and the play is started once again by closing the door 26, pulling the hand 30 downwardly to lock the door 26 in its closed configuration, followed by the players once again taking turns inserting their objects 24 into the toy 20. The player whose object 24 opened the door 26 of course has accumulated more of the objects 24 than he started out with, and therefore has an immediate advantage. Play is continued until the players in turn go out of the game by having deposited all of their objects 24 into the toy 20 and having been unsuccessful in having their particular object 24 open the door 26 such thay they could resupply their stock of objects 24. Eventually, one player will possess all of the objects 24, at which time the objects 24 are redistributed among the players according to color or the like and the play can start over again.

A projection 36 is located on the front of the toy 20 and prevents the hand 30 from being overly rotated when it is pushed downwardly in closing the door 26. Also exposed on the front side of the toy 20 are eyes, collectively identified by the numeral 28. As hereinafter explained, upon insertion of each of the individual objects 24, the eyes 38 spin. The spin of the left and right eye are different, such that upon insertion of each of the individual objects 24, the two eyes assume a different position with respect to one another, giving the toy 20 a different outwardly appearance with each addition of an object 24. This has a comical effect and serves as an indication that an object 24 has been inserted into the slot 22.

The toy 20 is encased in a front housing 39 and a rear housing 40. The door 26 is hinged to the front housing 39. The two housings 39 and 40 are held together by a plurality of screws which appropriately join them together and hold all of the internal components fixed inside the toy 20. The knob 34 is exposed out of an opening in the rear housing 40 such that it is accessible for rotation in order to randomize play of the toy 20 each time the door 26 is open.

Figure 3:
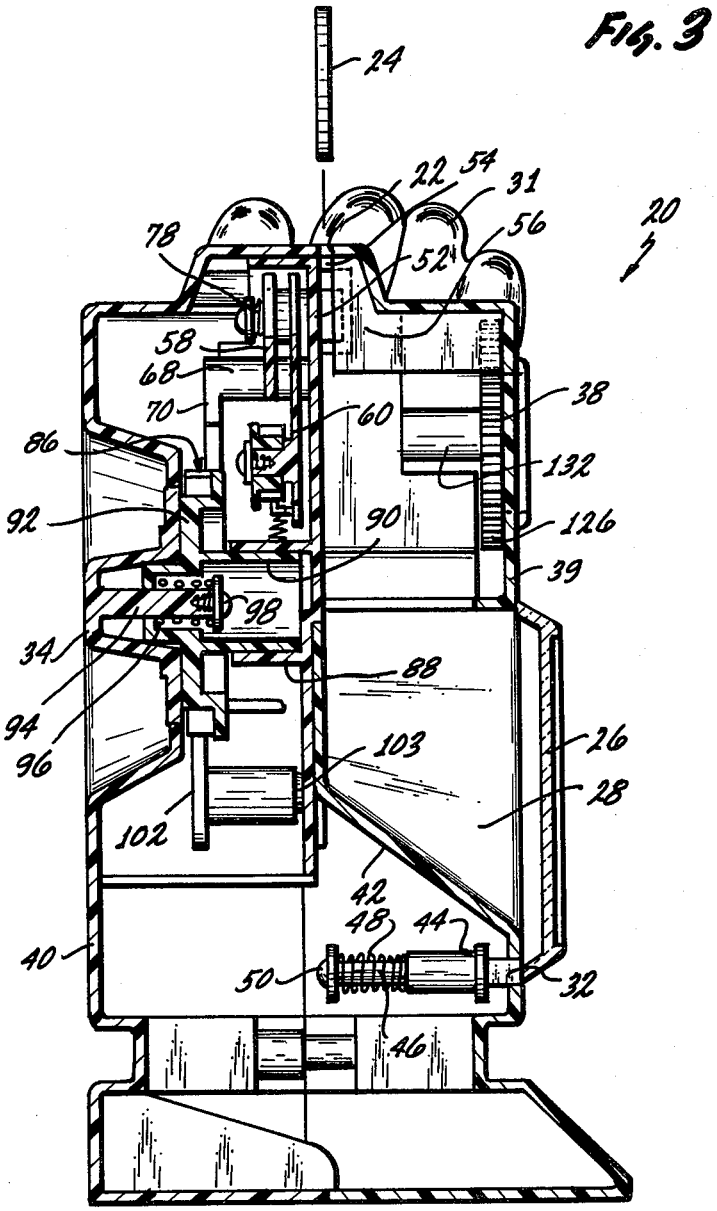
FIG. 3 is a side elevational view in section about the line 3—3 of FIG. 1.

As can be seen in FIG. 3, a sloping bottom wall 42 forms the lowermost surface within the chamber 28. Because this bottom wall 42 is sloped, any objects 24 which are located in the chamber 28 slide out of the chamber 28 under gravity when the door 26 is opened. As noted above, the projection 32 biases the door 26 from a closed position to an open position. The projection 32 is formed as a part of a member 44 which is mounted about a boss 46 formed as a part of the front housing 39. A spring 48 is located around the boss 46 and is maintained on the boss 46 by a screw 50. The spring 48 is compressed between the screw 50 and the member 44 when the projection 32 is pushed inwardly upon closing the door 26. This biases the member 44 and the projection 32 located thereon outwardly from the front housing 39 to provide the biasing force to urge the door 26 from the closed position to the open position.

Figures 5, 6:
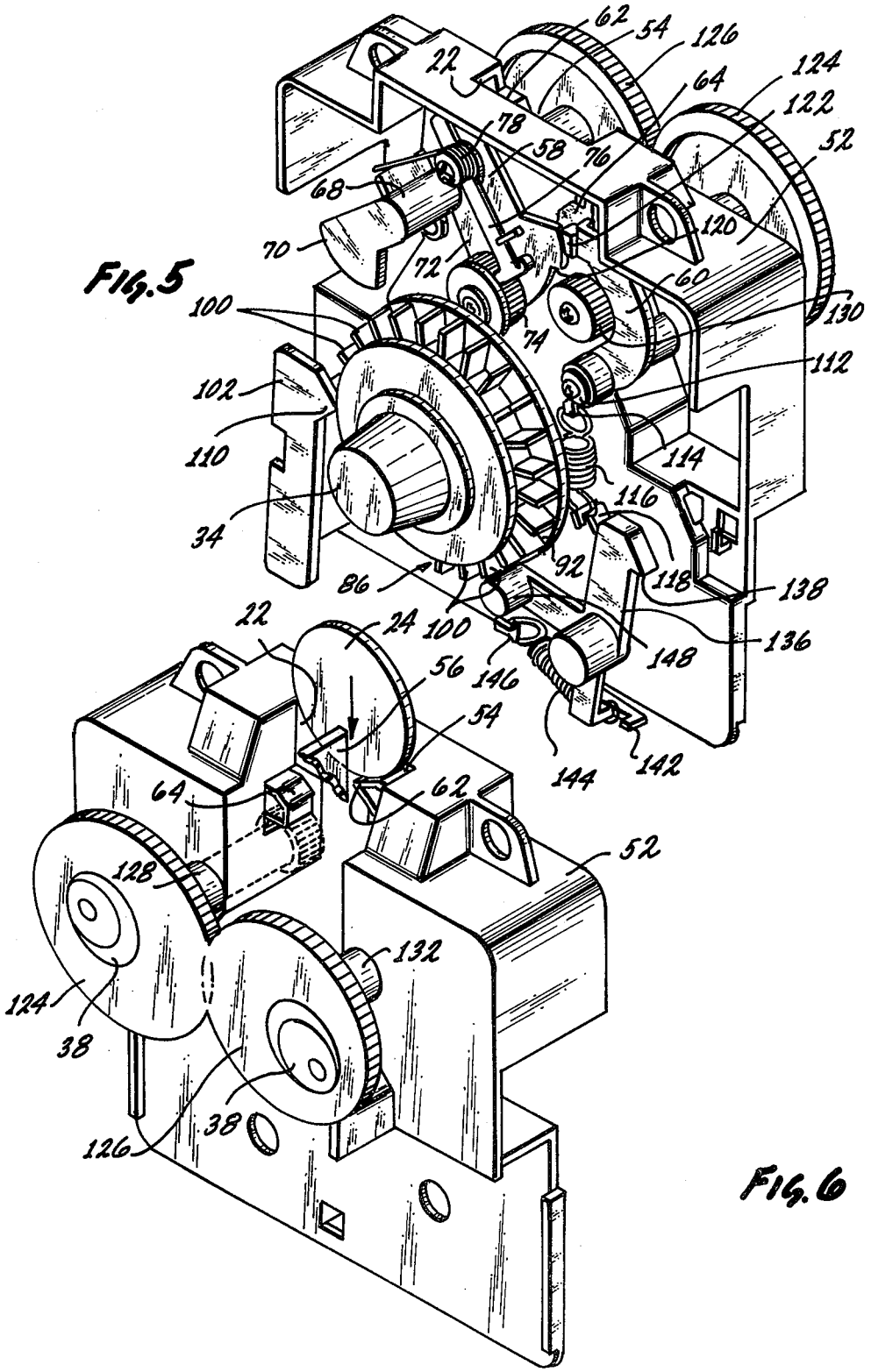
FIG. 5 is an oblique view from the rear showing certain of the components seen in FIG. 4.
FIG. 6 is an oblique view from the front of the components seen in FIG. 5.

An internal housing 52 is located inside the toy 20 and is held in place by being appropriately interlocked between the front and rear housings 39 and 40, respectively. An object guide or pathway space 54 leads downwardly from the slot 22 and eventually opens into the top of the chamber 28. The object pathway 54 is formed in part by a surface of the internal housing 52 and in part by a web 56 formed as a part of the front housing 39. When an object 24 is pushed into the slot 22, it moves downwardly within the object pathway 54 between the web 56 and part of the internal housing 52. As the object 24 moves downwardly within the pathway 54, it first interacts with an actuator member 58 and then with an actuator release member 60. Interaction with the actuator member 58 and the actuator release member 60 is via contact with the end 62 of the actuator member 58 and end 64 of the actuator release member 60. The ends 62 and 64 project out of appropriate openings (not identified or numbered) which are formed in the internal housing 52. The end 62 of the actuator member 58 is positioned higher within, and on the upper side of, pathway 54 than is the end 64 of the actuator release member 60, such that the object 24 first contacts the end 62 of the actuator member 58, depressing this end to the right as seen in FIG. 6, and rotating the actuator member 58 counterclockwise as viewed in FIG. 7, and then contacting the end 64 of the actuator release member 60, depressing the end 64 to the left as viewed in FIG. 6, and rotating the actuator release member 60 clockwise as seen in FIG. 8.

After passing downwardly from the end 64 of the actuator release member 60, the object 24 then drops out of the bottom of the pathway 54 and is captured within the chamber 28 behind the door 26.

Figure 4:
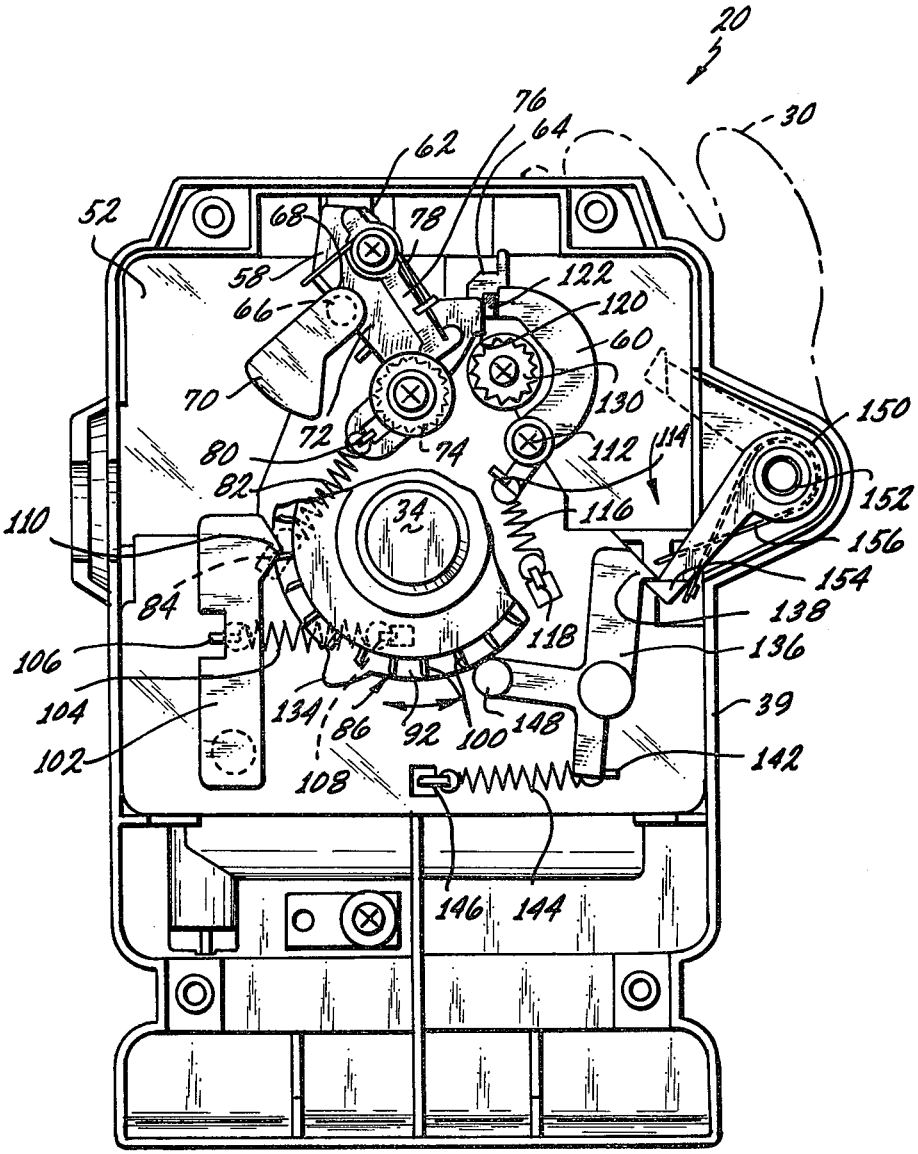
FIG. 4 is a rear elevational view in partial cutaway showing certain of the internal components of the preferred embodiment of the invention with some of the components shown in both solid lines and in phantom line in two different spatial configurations.

A boss 66 as is seen in FIG. 4 is formed as a part of the internal housing 52 and projects backwardly. The actuator member 58 is rotatably mounted about the boss 66. The actuator member 58 is a complex shaped member and includes several functional parts. It has a barrel 68 which fits over the boss 66 such that the actuator member 58 is rotatably mounted to the internal housing 52. On the backward end of the barrel 68 is an arm 70, whose function will be delineated below. A plate 72 attaches to the barrel 68 and includes the end 62 located thereon. The plate 72 has a small pinion 74 mounted thereon by a screw. The pinion 74 can rotate clockwise, as seen in FIG. 4, on plate 74; however, it is prevented from rotating counterclockwise because of the interaction of an arm 76 against it, which is also rotatably mounted to the plate 72 and is biased against the pinion 74 by a hairpin spring 78.

The plate 72 further includes a tab 80, to which a spring 82 is attached. The other end of the spring 82 is attached to a tab 84 formed on the internal housing 52. The spring 82 thus biases the actuator member 58 clockwise as seen in FIG. 2.

A chance member 86, which includes knob 34 as a part thereof, is rotatably mounted to the internal housing 52 by fitting within a hollow boss 88 formed on the internal housing 52. The chance member 86 has a skirt 90 which fits into the hollow boss 88 and thus allows free rotation of the chance member 86 with respect to the internal housing 52. The skirt 90 is formed as a portion of a plate 92. The plate 92 has a hole in the center. The knob 34 has a boss 94 located on its back side which fits within the hole in the plate 92. A compression spring 96 is located around the boss 94 and is compressed between the plate 92 and a screw 98 which screws into the boss 94. The spring 96 pushes against the head of the screw 98 which holds the knob 34 tightly against the plate 92, but which, however, allows for slipping of the knob 34 against the plate 92 if one or the other is held fixed while the other is rotated. The plate 92 has a plurality of radially projecting projections, collectively identified by the numeral 100, which are arranged circumferentially around it. The radial projections 100 are located such that when the actuator member 58 is rotated counterclockwise, as viewed from the rear, such as in FIGS. 4, 5, and 7 through 9, the arms 70 of the actuator member 58 contact one of the individual radial projections, such as projection **100*a*, on the chance member 86, to rotate the chance member 86 clockwise (as viewed in these same FIGS.). Thus, as one of the objects 24 travels down the object pathway 54, it first moves the actuator member 58 and this movement, in turn, causes rotation of the chance member 86**.

A positioning member 102 is located to the left hand side of the chance member 86 as viewed from the back in the FIGS. outlined in the preceding paragraph. The positioning member 102 fits on a boss 103 formed on internal housing 52, and can freely rotate about this boss. A spring 104 connects to a tab 106 on the positioning member 102 and to a second tab 108 on the internal housing 52. This biases the positioning member 102 against the chance member 86.

Figure 7:
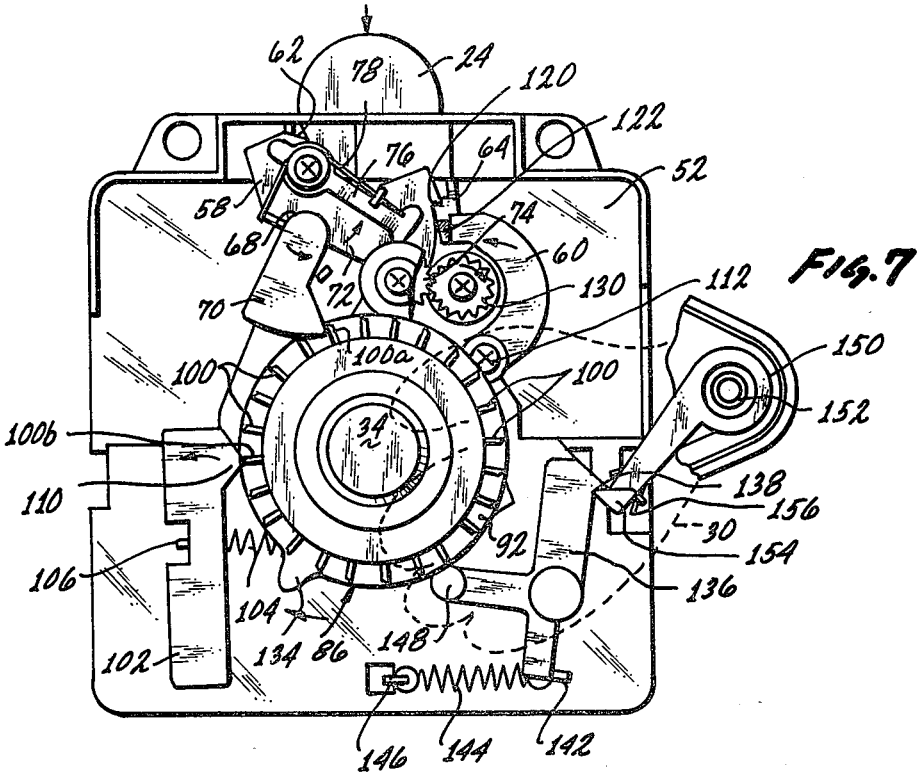
FIG. 7 is a rear elevational view showing certain of the components seen in FIG. 5 in a first spatial relationship.
Figure 8:
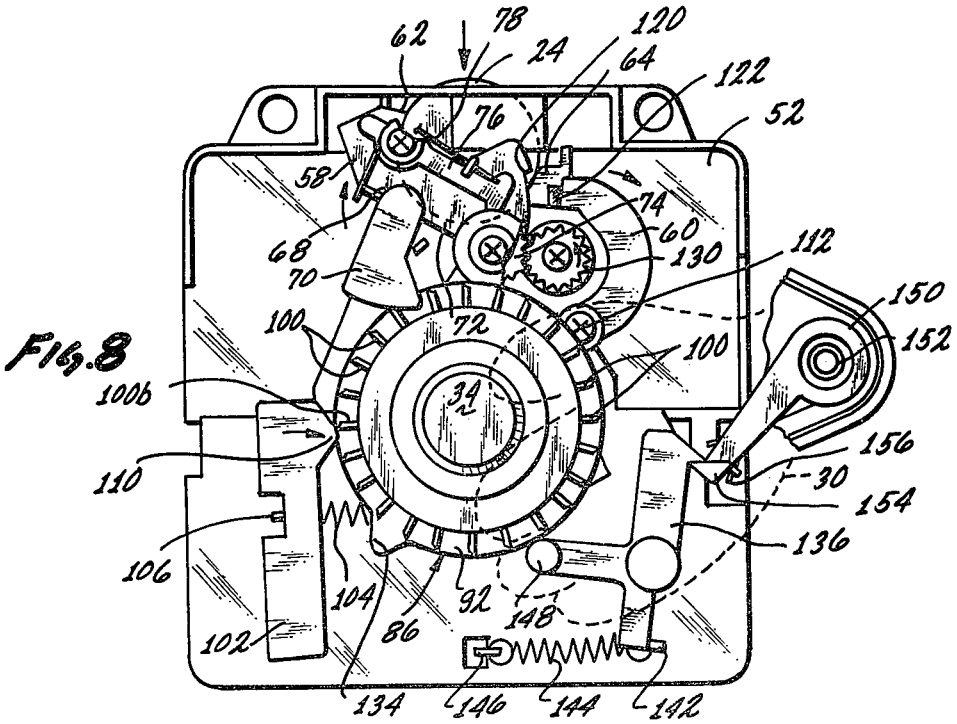
FIG. 8 is an oblique view similar to FIG. 7 showing certain of the components in a second spatial relationship.

As can be seen in FIGS. 7 and 8, when an object 24 is inserted into slot 22, the object 24 contacts the end 62 of the actuator member 58, as mentioned before. This pivots the actuator member 58 counterclockwise on the internal housing 52. The counterclockwise pivot of the actuator member 58 causes the arm 70 of this member to contact one of the radial projections 100, as seen in FIG. 7. This contact results in clockwise rotation of the chance member 86 to accompany the counterclockwise rotation of the actuator member 58. As long as the object 24 is pressing against the end 62 of the actuator member 58, the actuator member 58 continues to rotate in a counterclockwise rotation, from an initial position to a subsequent position, forcing the chance member 86 to further rotate in its clockwise rotation. As the chance member 86 to further rotate in its clockwise, the point 110 of the positioning member 102 contacts another of the radial projections **100*b*. Because of this contact, the positioning member 102 is rotated counterclockwise to the left, tensing the spring 104. In FIG. 7, the point 110 of the positioning member 102 has been moved to the very end of the radial projection 100*b*** with which it is in contact.

Moving now to FIG. 8, the object 24 has been inserted sufficiently far into the object pathway 54 such that it is no longer pushing the end 62 of the actuator member 58 to the left, but, in fact, is allowing the actuator member 58 to move clockwise under the bias of the spring 82 back to its initial position. As soon as the actuator member 58 reverses its motion from a counterclockwise to a clockwise rotation, the arm 70 no longer exerts any force against the radial projection **100*a* with which it is in contact and thus no longer further rotates the chance member 86. The point 110 on the positioning member 102 is, however, still in contact with the radial projection 100*b***.

The shape of the point 110 of the positioning member 102 is such that it further biases the chance member 86 clockwise, to position the chance member 86 and the positioning member 102 in the position as seen in FIG. 4. Thus, stepwise, before insertion of an object 24, these components would be as seen in FIG. 4. In FIG. 4, the actuator member 58 would be in its initial position and the point 110 of the positioning member 102 would be located between two of the radial projections 100. Upon insertion of the object 24, as seen in FIG. 7, the actuator member 58 and the chance member 86 are caused to rotate and the positioning member 102 is moved outwardly from the chance member 86. After the object 24 has moved downwardly within the object pathway 54, the point 110 on the positioning member 102 has been moved upwardly and across the one radial projection 100 with which it was in contact, and when the actuator member 58 returns to its initial position, as seen in FIG. 4 and hereinafter explained, the bias of the spring 104 moves the point 110 of the positioning member 102 to the right, as in FIG. 8, to further rotate the chance member 86 until the components are relocated in the position as seen in FIG. 4.

The actuator release member 60 is pivotally mounted to the internal housing 52 about a screw 112, which passes through it. It has a tab 114 located on its end. A spring 116 extends between tab 114 and a tab 118 formed on the internal housing 52. This biases the actuator release member 60 clockwise as seen in FIG. 4.

The actuator member 58 includes a shoulder 120 located thereon. The actuator release member 60 includes a lip 122 located thereon. When the actuator member 58 is in its initial position as is seen in FIG. 4, the shoulder 120 located on it is located below the lip 122 located on the actuator release member 60. Under the influence of movement of an object 24 against the end 62 of the actuator member 58, it is rotated counterclockwise as noted before, and as seen in FIG. 7. This rotation moves the shoulder 120 upwardly with respect to the lip 122. This allows the actuator release member 60 to move counterclockwise as seen in FIG. 7. As the object 24 continues to progress down the pathway 54, after abutting against the end 62 of the actuator member 58, it then abutts against the end 64 of the actuator release member 60. Further downward movement of the object 24 pushes the end 64 of the actuator release member 60 to the right, as seen in FIG. 8, and after the object 24 is no longer in position against the end 62 of the actuator member 58, it can then rotate clockwise. Because the lip 122 is moved to the right of the shoulder 120, the actuator release member 60 does not inhibit this clockwise rotation of the actuator member 58.

If the object 24, instead of being pushed all the way down into the slot 22, is only pushed part way, such that it contacts the end 62 of the actuator member 58 and rotates the actuator member 58 sufficient to move the chance member 86 and then is withdrawn before contact with the end 64 of the actuator release member 60 was made, the actuator member 58 would have been rotated sufficiently counterclockwise to lift the shoulder 120 above the lip 122. However, since the actuator release member 60 had not been rotated clockwise, the lip 122 would not have been moved to the right as it is in FIG. 8, but would be located directly underneath the shoulder 120 as it is in FIG. 7. Upon withdrawal of the object 24 upwardly in the slot 22, the actuator member 58 would rotate clockwise. However, it could not return to its initial position because the shoulder 120 would become locked on the lip 122. This locks the plate 72 in engagement with the chance member 86, which then prevents further rotation of the chance member 86 by either the positioning member 102 or by turning the knob 34. This mechanism, in effect, prevents cheating by the players, by preventing one player from inserting his object 24 part way into the slot 22 and then withdrawing the same. The sequence of events necessary to rotate the chance member 86 from one position to another position requires that the object 25 complete its travel through the pathway 54 and interact with both the actuator member 58 and the actuator release member 60.

The chance member 86 can move through a variety of positions, corresponding to the number of spaces between every two adjacent radial projections 100. The actuator member 58 moves from its initial position, which would be the position seen in FIG. 4, to a subsequent position, such as the position seen in FIG. 8, and is allowed to move back to its initial position only when the object 24 completely descends through the pathway 54 and interacts with the actuator release member 60. If the actuator member 58 becomes locked by interaction of the lip 122 with the shoulder 120, as described above, and then the knob 34 is rotated while the chance member 86 is fixedly held by the plate 72, slippage of the plate 92 against the knob 34 prevents rotation of the plate 92, even though the knob 34 is rotated.

The eyes 38 are respectively located on disks 124 and 126. Disk 124 is attached to axle 128, which is journaled in an appropriate bearing surface (not separately identified or numbered), located in the internal housing 52. The axle 128 includes a small pinion 130 fixedly attached to its end. The disk 126 is mounted to an axle 132, which is also journaled in the internal housing 52. Each of the disks 124 and 126 have gear teeth around the perimeters and disk 124 and 126 are located with respect to one another such that these gear teeth mesh. Rotation of pinion 130 is thus transferred via axle 128 to rotate disk 124, which in turn rotates disk 126. The outside diameters of the disks 124 and 126 are different such that the indicia (not separately identified or numbered) located on these respective disks will not move synchronously with respect to one another, such that a variety of different eye positions are achieved on the toy 20 as objects 24 are inserted into the toy 20.

The pinion 130 on the axle 128 is positioned such that it interacts with the pinion 74 located on the actuator member 58 as the actuator member 58 is moved. As the actuator member 58 is moved under the influence of an object 24 going down the object pathway 54, the actuator member 58 moves slowly in a counterclockwise direction. The rate of this movement is governed by the rate of the insertion of the object 24 into the toy 20. When the object 24 has cleared the end 62 of the actuator member 58 and is released from the operator who is inserting it into the toy 20, the bias in the spring 82 then rapidly moves the actuator member 58 from its subsequent position back to its initial position. This once again engages the pinion 74 with pinion 130. However, rotation of pinion 130 is now in the opposite direction. Because of the rapid counterclockwise movement of the actuator member 58 back toward its initial position, the engagement of the pinion 74 with the pinion 130 imparts considerable momentum to this pinion, which is in turn imparted to the disks 124 and 126. After the actuator member 58 has returned to its initial position, as seen in FIG. 4, the momentum imparted to the disks 124 and 126 by interaction of the pinion 74 with the pinion 130 is such to maintain rotation of these disks 124 and 126 for a further increment of time. As such, upon depositing each of the objects 24 into the toy 20, the disk 124 and 126 will be rotated for an increment of time to reposition them with respect to one another and render the comical effect to the toy 20. The rotation of the disks 124 and 126 is an indication that an object 24 has been deposited into the toy 20.

The chance member 86 includes a cam 134 on its surface. As the chance member rotates, the cam 134 also rotates. A first connecting member 136 is pivotally mounted on the internal housing 52. The first connecting member 136 is shaped as a bell crank with a detent 138 located on the end of one of its arms. The first connecting member 136 has a hollow bearing 140 formed as a part of it, which fits over an upstanding boss, not seen or numbered, to appropriately rotatably mount the first connecting member 136 to the internal housing 52.

Figure 9:
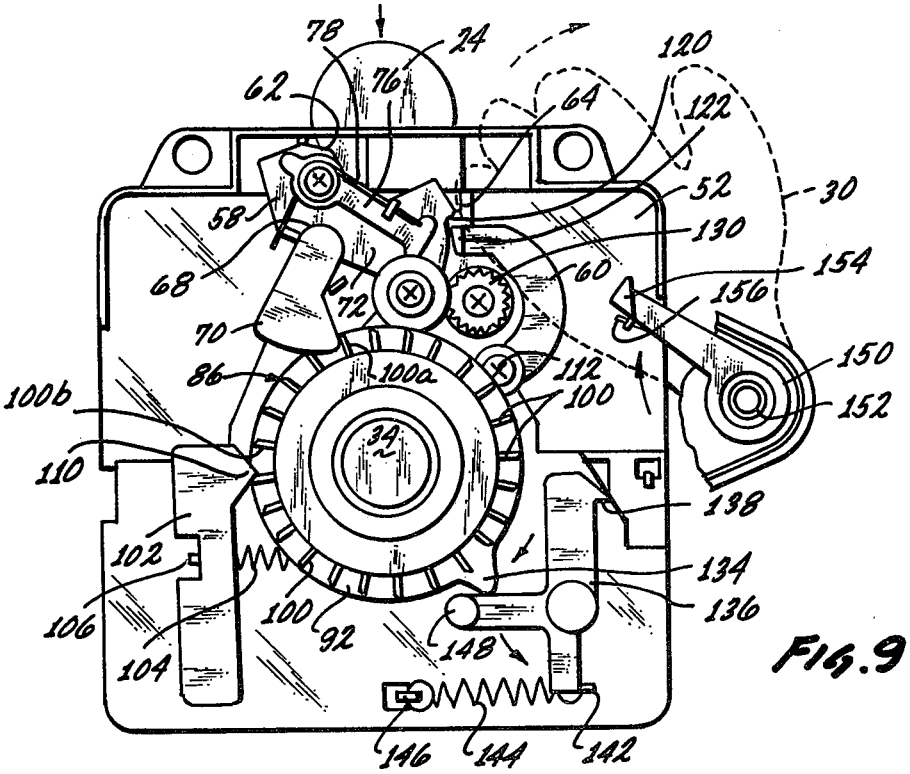
FIG. 9 is a rear elevational view similar to FIG. 7 showing certain of the components in a further spatial relationship.

The first connecting member 136 includes a tab 142 to which a spring 140 is attached. The other end of spring 140 is connected to a tab 146 formed on the internal housing 52. The spring 146 biases the first connecting member 136, as seen in FIG. 9, clockwise. The first connecting member 136 also includes a cam follower surface 148 located on the end of its other arm.

As the chance member 86 rotates either clockwise or counterclockwise, the cam 134 can contact the cam follower 148 to cause counterclockwise movement of the first connecting member 136, as viewed in FIG. 9.

A second connecting member 150 has an axle 152 formed as a part thereof. The axle 152 attaches to the hand 30. The axle 152 is approximately journaled within bearing surfaces, not numbered, formed in the front and rear housings 38 and 40. This allows rotation of the second connecting member 150 with respect to the front and rear housings 38 and 40 and movement of the hand 30 upwardly to release the door 26 and downwardly to lock the door 26 in a closed position. The second connecting member 150 includes a tooth 154 which is located on its end and is positioned to interact with the detent 138 on the first connecting member 136.

Figure 10:
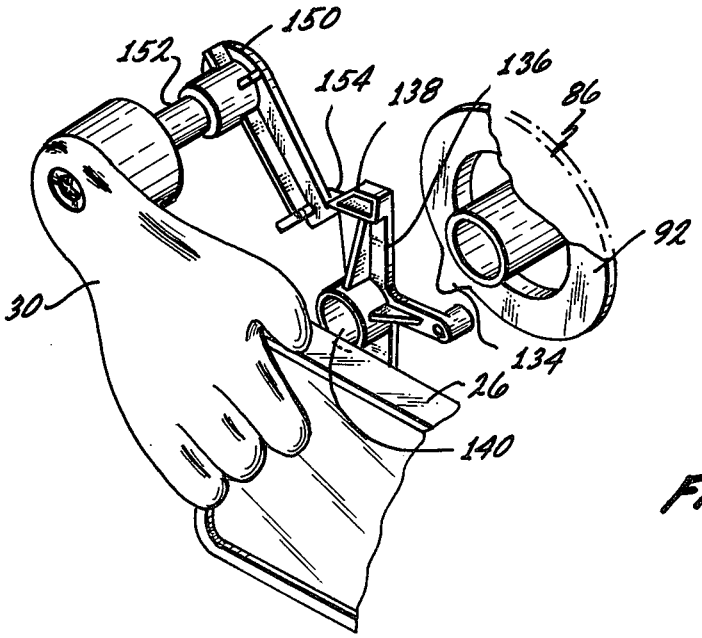
FIG. 10 is an oblique view of certain of the components seen near the right hand side of FIG. 7 and in phantom line in FIG. 7, showing these components as viewed from the front.

When the hand 30 is holding the door 26 in a closed position, that is, when it is located in its downward position as seen in FIG., 1, this locates the tooth 154 on the second connecting member 150 in position to interact with the detent 138 on the first connecting member 136. This can be seen in solid line in FIG. 4, or in an exploded view in FIG. 10. When the cam 134 contacts the cam follower 148 such that the first connecting member 136 is rotated, this releases the tooth 154 from the detent 138.

A hairpin spring 156 is located around the axle 152 and biases the second connecting member 150 to the position shown in phantom line in FIG. 4. When the tooth 154 is released from the detent 138, the spring 156 thus moves the second connecting member from its position shown in solid line in FIG. 4 to its position shown in phantom line in FIG. 4. This results in movement of the hand 30 to the position shown in phantom line in FIG. 4 or to the position shown in FIG. 2. Thus, upon contact of the cam 134 with the cam follower 148, the first connecting member 136 is moved, allowing release of the second connecting member 150, and under the influence of spring 156, hand 30 is moved upwardly, allowing the door 26 to open under the influence of the projection 32 and the spring, previously identified, associated with it.

As noted above, the chance member 86 moves stepwise through a plurality of positions equal in number to the number of spaces between the radial projections 100. The chance member 86 is moved in a clockwise direction as viewed in FIG. 9 under the influence of an object 24 being inserted into the object slot 22. When the chance member 86 is located in the position shown in FIG. 9, such that the cam 134 is located adjacent to the cam follower 148, insertion of the next object 24 will cause sufficient rotation of the chance member 86 such that the cam 134 thus interacts with the cam follower 148 to move the chain of components previously described to lift the hand 30 to open the door 26.

After the door 26 is opened and the contents of the chamber 28 released, or at the start of the game, the door 26 is closed, and the hand 30 pivoted down over it to hold it in this closed position. The hand 30 is momentarily held in this downward position while the chance member 86 is spun by rotating the knob 34. This moves the cam 134 out of contact with the cam follower 148, allowing for locking of the cam 134 in this downward position by interaction with the detent 138 with the tooth 154. The cam 134 is formed as a part of the plate 92 and not as a part of the knob 34. Only the knob 34 is exposed out of the back of the rear housing 40. Thus, the players utilizing the toy 20 have no idea of the position of the cam 134, and, upon spinning of the knob 34, its position is seemingly randomly set. Those utilizing the toy 20 do not know whether one or more object 24 will thus cause the opening of the door 26, or whether a plurality of objects 24 are needed. This creates a suspensful element in utilizing the toy 20. It is, of course, realized that more than one cam 134 could be utilized on the chance member 86. However, since the position of the cam 134 is unseen by the players of the toy 20, only one cam 134 is actually needed.

We claim:

1. A toy capable of receiving and dispensing objects which comprises:

a plurality of said objects;

a housing;

an accumulator means located on said housing, said accumulator means capable of individually receiving said objects, accumulating said objects so received and dispensing all of said objects so accumulated;

a movable mechanical chance means located on said housing in operative association with said accumulator means, said chance means movable between a plurality of positions, at least one of said positions being a dispensing position;

activation means mounted on said housing in operative association with both said chance means and said accumulator means, said activation means being movable on said housing between at least an initial position to a subsequent position by interaction of said activation means with one of said objects as said object is received by said accumulator means, said activation means in moving from said initial position to said subsequent position moving said chance means from one of its positions to another of its positions;

inhibitor means, said inhibitor means associated with said activation means, said inhibitor means located on said housing in operative association with said activation means, said inhibitor means positioned on said housing such that said object must stepwise interact with said activation means followed by interaction with said inhibitor means prior to being accumulated by said accumulator means, said inhibitor means capable of inhibiting said activation means from interacting with said chance means until said object has interacted with said inhibitor means;

said accumulator means dispensing any of said objects accumulated in response to said chance means moving to its dispensing position from another of its positions.

2. The toy of claim 1 including:

an object guide means located on said housing in association with both said activation means and said accumulator means, said object guide means capable of receiving said object and guiding said object to said accumulator means, said object interacting with said activation means to move said activation means from its subsequent position as said object is guided by said guide means to said accumulator means.

3. The toy of claim 2 including:

connecting means movably mounted on said housing and associated with said chance means, said connecting means capable of moving between a retaining position and a discharge position, when said connecting means is in said retaining position said accumulator means accumulating said objects so received by said accumulator means and when said connecting means is in said discharge position said accumulator means dispensing all of said objects so accumulated, said connecting means moving from its retaining position to its discharge position in response to said chance means moving to its dispensing position.

4. The toy of claim 3 wherein:

said chance means includes a chance member movably mounted on said housing, said chance member including a plurality of interacting means of a first type located on it and at least one interacting means of a second type located on it, said interacting means of said first type interacting with said activation means to move said chance member in response to movement of said activation means from its initial to its subsequent position, said interacting means of said second type interacting with said connecting means to move said connecting means from its retaining position to its discharge position.

5. The toy of claim 4 wherein:

said object guide means comprises an object pathway on said housing, said pathway having an inlet and an outlet, said inlet so located so as to receive said objects, said outlet so located in association with said accumulator means so as to transfer objects from said object pathway to said accumulator means;

said activation means located in association with said object pathway so as to be acted on by an object as said object traverses through said pathway from said inlet to said outlet.

6. A toy capable of receiving and dispensing objects which comprises:

a plurality of said objects;

a housing;

an accumulator means located on said housing, said accumulator means capable of individually receiving said objects, accumulating said objects so received and dispensing all of said objects so accumulated;

an object pathway on said housing, said pathway having an inlet and an outlet, said inlet located so as to receive said objects, said outlet located in association with said accumulator means so as to transfer objects from said object pathway to said accumulator means;

an activation member rotatably mounted on said housing to move from an initial position to a subsequent position;

an activation biasing means associated with said activation member to bias said activation member toward said initial position;

said activation member located in association with said object pathway so as to be acted on by an object as said object traverses through said pathway from said inlet to said outlet, said activation member moving from said initial position to said subsequent position upon interaction of said activation member with an object as said object moves in said pathway;

a chance member movably mounted on said housing, said chance member movable between a plurality of positions, at least one of said positions being a dispensing position, said chance member including a plurality of interacting means of a first type located on it and at least one interacting means of a second type located on it, said activation member interacting with said interacting means of said first type to move said chance member in response to said activation member moving from its initial position to its subsequent position;

connecting means mounted on said housing in association with said chance means and said accumulator means, said connecting means capable of moving between a retaining position and a discharge position, when said connecting means is in said retaining position said accumulator means accumulating said objects and when said connecting means is in said discharge position said accumulator means dispensing said objects, said interacting means of said second type interacting with said connecting means to move said connecting means from its retaining position to its discharge position.

7. The toy of claim 6 wherein:

said chance member is rotatably mounted on said housing and said activation member is capable of moving said chance member stepwise with respect to said housing;

said chance member further including positioning means capable of positioning said chance member in a plurality of positions as said chance member rotates on said housing.

8. The toy of claim 7 wherein:

said connecting means includes at least a first connecting member located on said housing in association with said chance member, said first connecting member movably mounted on said housing;

said interacting means of said second type comprising a cam means located on said chance member, said cam means interacting with said first connecting member when said chance means is in said dispensing position to move said first connecting member.

9. The toy of claim 8 wherein:

said accumulator means comprises a chamber means located in said housing and having said outlet of said object pathway formed as a first opening in said chamber means;

said chamber means including a second opening having closure means, said second opening forming an opening in said housing for discharging said objects from said housing, said closure means capable of sealing said second opening such that said objects are capable of being accumulated within said chamber means and said closure means capable of unsealing said second opening allowing for the dispensing of said objects from said chamber means;

said closure means operatively associated with said connecting means and unsealing said second opening in response to movement of said first connecting member by interaction with said cam means.

10. The toy of claim 9 wherein:

said connecting means includes a second connecting member movably located on said housing in association with said first connecting member and said closure means, said second connecting member movable in response to movement of said first connecting member, said closure means movable in response to movement of said second connecting member.

11. The toy of claim 10 wherein:

said closure means includes a closure member movably mounted on said housing between a sealed and an unsealed position;

said closure means further includes closure biasing means associated with said closure member and biasing said closure member from said sealed to said unsealed position;

at least a portion of said second connecting member movably mounted on said housing in a position adjacent to said closure member, said second connecting member moving between a retaining position wherein said second connecting member retains said closure member in a sealed position against the bias of said closure biasing means and a non-retaining position wherein said second connecting member does not retain said closure member against the bias of said closure biasing means allowing said closure biasing means to move said closure member from said sealed to said unsealed position.

* * * * *